United States Patent [19]

Eckert

[11] 3,967,607

[45] July 6, 1976

[54] FUEL INJECTION SYSTEM

[75] Inventor: Konrad Eckert, Stuttgart-Feuerbach, Germany

[73] Assignee: Robert Bosch G.m.b.H., Stuttgart, Germany

[22] Filed: Sept. 23, 1974

[21] Appl. No.: 508,563

[30] Foreign Application Priority Data

Oct. 3, 1973 Germany ..... 2349688

[52] U.S. Cl. ..... 123/139 AW; 123/32 AE; 123/119 R

[51] Int. Cl.[2] ..... F02D 1/00

[58] Field of Search ..... 123/139 AW

[56] References Cited

UNITED STATES PATENTS

| | | | |
|---|---|---|---|
| 3,730,155 | 5/1973 | Knapp | 123/139 AW |
| 3,765,387 | 10/1973 | Knapp | 123/139 AW |
| 3,842,813 | 10/1974 | Eckert | 123/139 AW |

*Primary Examiner*—Wendell E. Burns
*Assistant Examiner*—James W. Cranson, Jr.
*Attorney, Agent, or Firm*—Edwin E. Greigg

[57] ABSTRACT

In an internal combustion engine employing manifold fuel injection, the air flow rate through the induction manifold controls the motions of a slide in a metering and distribution valve assembly. The slide, in turn, controls the effective metering valve apertures of several individual openings, each leading first to an equal pressure diaphragm valve and, hence, to individual fuel injection nozzles.

The system includes a differential pressure control valve, which maintains a constant pressure difference across the metering valve apertures in the metering and distribution valve assembly. The differential pressure control valve may be in parallel or series connection with the several equal pressure diaphragm valves. The system also includes a pressure control valve, responsive to engine parameters, which adjusts the resetting force acting on the control slide in the metering and distribution valve assembly.

11 Claims, 2 Drawing Figures

FUEL INJECTION SYSTEM

BACKGROUND OF THE INVENTION

The invention relates to a fuel injection system for mixture compressing, spark plug ignited internal combustion engines employing continuous injection into the induction manifold, in which an air-flow measuring element and an arbitrairly actuatable butterfly valve are disposed in sequence. The air-flow measuring element is displaced corresponding to the air flow through the induction tube and against a resetting force produced by pressurized fluid and thereby moves the movable member of a valve assembly disposed within the fuel line for the purpose of metering out a fuel quantity proportional to the air quantity. The metering process occurs at a constant pressure difference.

Fuel injection systems of this type serve the purpose of automatically creating a favorable fuel-air mixture for all operational conditions of the internal combustion engine in order to make possible a complete combustion of the fuel and thus to avoid or at least to reduce sharply the production of toxic exhaust components while maintaining the highest possible performance of the internal combustion engine or the least possible fuel consumption. For this reason, the fuel quantity must be metered out very precisely according to the requirements of each operational state of the internal combustion engine and the proportionality between the air quantity and the fuel quantity must be changed in dependence on motor parameters, e.g. r.p.m., load, temperature and exhaust gas composition. The laws and regulations affecting the permissible exhaust gas constituents of vehicle engines are becoming more severe all the time and make necessary a very precise control of the optimum injected fuel quantity.

OBJECT AND SUMMARY OF THE INVENTION

It is an object of the present invention to provide a fuel injection system of the kind described which satisfies the above requirements but which operates with simpler means than has heretofore been the case.

This object is attained, according to the invention, in that a differential pressure control valve acts through equal pressure valves to hold constant the pressure difference prevailing at each of the metering valve apertures which are assigned to the individual fuel injection valves.

A preferred feature of the invention provides that the differential pressure control valve is embodied as a flat seat valve with a diaphram as the movable valve member separating two chambers which can be connected by a throttle aperture located in the diaphragm.

Another preferred characteristic of the invention provides that the differential pressure control valve and the several equal pressure valves are in mutually parallel configuration.

In another preferred embodiment of the invention, the differential pressure control valve and the equal pressure valves are in series configuration, and, at a location upstream of the equal pressure valves, there is disposed a throttle across which a constant pressure difference can be produced by means of the differential pressure control valve and this constant pressure differences may be transmitted through the equal pressure valves to act across the metering valve apertures.

It is also a preferred feature of the injection system according to the invention that the differential pressure control valve, a further pressure control valve, a system pressure valve and the equal pressure valves are all embodied as flat seat valves and may all share a common diaphragm as their movable valve member.

It may also be advantageously provided that the further pressure control valve is simultaneously embodied as the system pressure valve.

The invention preferably provides that the pressurized fluid for producing the resetting force acting on the control slide is engine fuel and that the control pressure of the pressurized fluid can be changed by the pressure control valve in dependence on engine parameters.

BRIEF DESCRIPTION OF THE DRAWING

Two exemplary embodiments of the invention are represented in the drawing wherein.

Elements common to both figures carry the same reference numerals.

DESCRIPTION OF THE PREFERRED EMBODIMENTS

Figure 1:
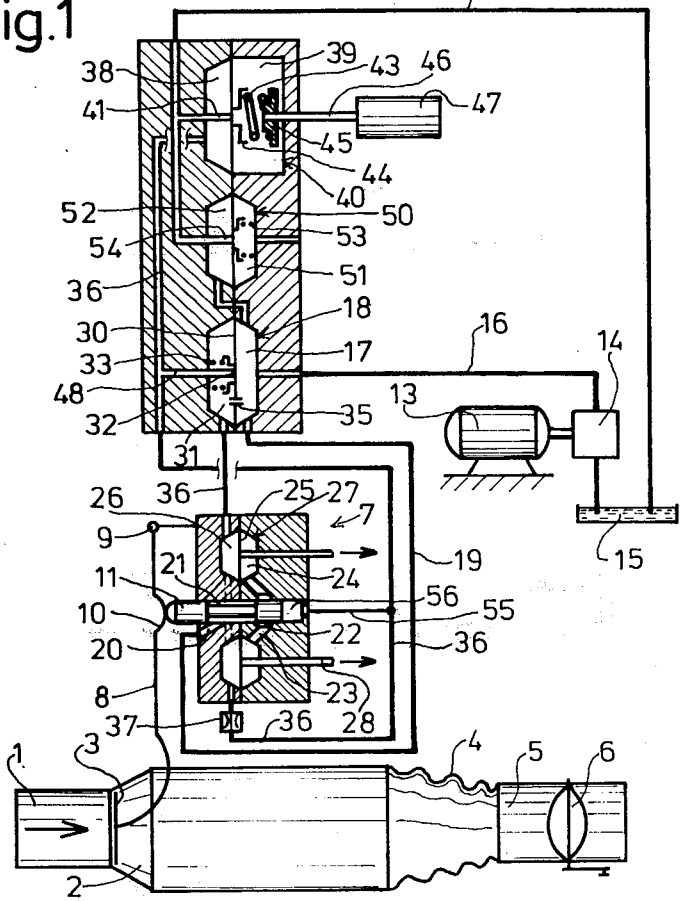
FIG. 1 is a diagram, partially in cross section, of a first exemplary embodiment of the invention.

In the fuel injection system shown in FIG. 1, combustion air flows in the direction of the arrow into an induction manifold 1 which has a conical region 2 enclosing an air-flow measuring element 3. The air then flows through a connecting hose 4 into an induction tube region 5 enclosing an arbitrarily actuatable butterfly valve 6 and continues to flow to one or several cylinders (not shown) belonging to an internal combustion engine. The air-flow measuring element 3 is embodied as a plate, disposed transverse with respect to the air flow, whose displacement within the conical region 2 of the induction tube is an approximately linear function of the air quantity flowing through the induction tube. The pressure prevailing between the measuring element 3 and the butterfly valve 6 remains constant provided that both the resetting force acting upon the measuring element 3 and the air pressure prevailing ahead of the measuring element 3 are constant.

The air-flow measuring element 3 directly actuates a metering and quantity distribution valve assembly 7. The motions of the air flow measuring element 3 are transmitted by a lever 8 connected thereto and pivoting about a point 9 whose projection 10 actuates the movable valve element to a control slide 11 of the metering and quantity distribution valve assembly 7.

A fuel pump 14 is driven by an electric motor 13 and delivers fuel from a fuel container 15 through a line 16 into a chamber 17 of a differential pressure control valve 18 and hence through a line 19 and a channel 20 into an annular groove 21 in the control slide 11. Depending on the control slide position, the annular groove 21 overlaps control aperture slits 22 to a greater or lesser degree and each of these control aperture slits communicates through channels 23 with a chamber 24 of an equal pressure diaphragm valve 27. A diaphragm 25, serving as the movable member of the equal pressure valve 27, separates chamber 24 from a chamber 26. From each of the chambers 24, fuel flows through lines 28 to the individual injection valves, (not shown) which are disposed within the induction tube in the vicinity of the engine cylinders.

The differential pressure control valve 18 is embodied as a flat seat valve, and its chamber 17 is separated by a diaphragm 30 from its other chamber 31 containing a fixed valve seat 32 and a spring 33 acting in the direction of opening. Chambers 17 and 31 of the differential pressure control valve 18 communicate via a throttle aperture 35, because of which the fuel pressure is decreased by the same amount as in the case at the metering valve apertures 21, 22. Chamber 31 of the differential pressure control valve 18 communicates through a line 36 with the chambers 26 of the several equal pressure valves 27. Thus, the same fuel pressure prevails in chambers 24 and 26 of the equal pressure valves 27 so that fuel may flow through channels 28 to the injection valves.

From chambers 26 of the equal pressure valves 27, fuel flows through a line 36, containing a throttle 37, to a chamber 38 of a pressure control valve 40. A diaphragm 30 separates chamber 38 from a chamber 39 of the pressure control valve 40. The pressure control valve 40 is embodied as a flat seat valve having a fixed valve seat 41, through which, in the open condition of the pressure control valve, fuel may flow at zero gauge pressure through a return line 42 back into the fuel container 15. The pressure control valve 40 is loaded in the direction of closing by a spring 43 whose one end is supported on the diaphragm with the aid of a spring support 44 and whose other end rests on a spring support 45. The compression of the spring 43 is adjustable by the axial sliding motion of the spring support 45, caused, via a guide rod 46, by an electromagnetic setting motor 47. For this adjustment, the engine parameters are either measured electronically or else are transformed into electrical parameters by an electric control instrument and actuate the electromagnetic setting motor 47 as appropriate electrical currents. The fuel overflowing the fixed valve seat 32 of the differential pressure control valve 18 flows through a line 48 and the line 36 to the pressure control valve 40.

The system pressure of the fuel injection system is regulated by a system pressure valve 50, embodied as a flat seat valve having two chambers 51 and 52, separated by a diaphragm 30 and held in its closed position by a spring 53. Fuel overflowing the fixed valve seat 54 can flow into the return line 42.

The fuel pressure regulated by the pressure control valve 40 is imparted through lines 36 and 55 to a chamber 56 into which extends that end of the control slide 11 which is farthest from the lever 8. This fuel pressure thus constitutes the resetting force acting upon the air-flow measuring element 3.

The method of operation of the fuel injection system showed in FIG. 1 is as follows:

When the internal combustion engine is running, air is aspirated through the induction tube 1, 4, 5. As a result, the measuring element experiences a certain displacement from its normal position. Corresponding to this displacement, the lever 8 moves the control slide 11 of the metering any quantity distribution valve assembly 7 which meters out fuel to the injection valve or valves of the engine. The direct linkage between the element 3 and the control slide 11 results in the constancy of the ratio of the air quantity to the metered-out fuel quantity.

In order to be able to make the fuel-air mixture richer or leaner, depending on the operating domain of the internal combustion engine, it is necessary to change the proportionality between the aspirated air quantity and the metered-out fuel quantity, in dependence on engine parameters. The change of the fuel-air mixture can be effected in that the resetting force at the measuring element 3 is changed while the pressure difference prevailing at the metering valve apertures 21, 22 remains constant. When dealing with internal combustion engines having several engine cylinders, it is advantageous to provide equal pressure valves in the metering and quantity distribution valve assembly 7 and to hold the pressure difference at the metering valve apertures 21, 22 constant by means of a differential pressure control valve.

In the first exemplary embodiment of the invention, the differential pressure control valve 18 and the equal pressure valve 27 are in parallel configuration.

Figure 2:
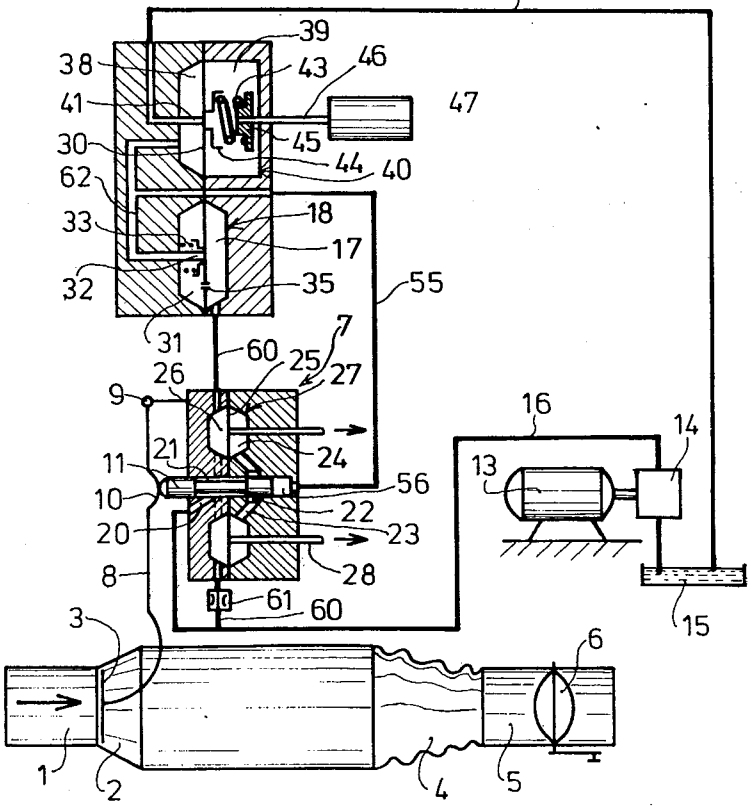
FIG. 2 is a diagram of a second exemplary embodiment of the invention.

In the second exemplary embodiment, depicted in FIG. 2, elements which remain identical to those of FIG. 1 retain the same reference numerals. In this second embodiment, a line 60 branches off from the supply circuit 16 and leads through a throttle 61 to the chambers 26 of the equal pressure valves 27 and hence into chamber 17 of the differential pressure control valve 18. From chamber 17 of the differential pressure control valve 18, fuel can flow through the throttle 35 and over the fixed valve seat 32 into a line 62 and hence to chamber 38 of the pressure control valve 40. Branching off from line 62 is a line 55 which communicates with chamber 56 into which extends the end of control slide 11 farthest from the lever 8. In this case, the equal pressure valves 27 and the diferential pressure control valve 18 are connected in series. Here, the differential pressure control valve 18 produces a constant fuel flow through throttle 61 which results in a constant pressure difference across it. Because of the interposition of the equal pressure valves 27, this pressure difference corresponds to the pressure difference prevailing at the metering valve apertures 21, 22. This arrangement offers the advantage that the pressure drop at the throttle 35 can be made larger than before and hence the differential pressure control valve 18 is made less sensitive. It also provides the possibility for control processes to intervene at the spring 33 in the differential pressure control valve 18. A further advantage of the second exemplary embodiment is that the pressure control valve is simultaneously embodied as a system pressure valve.

What is claimed is:

1. In a fuel injection system for mixture compressing, externally ignited internal combustion engines which include an engine induction manifold and means for continuous injection of fuel into the engine induction manifold, the system comprising: an air-flow measuring element and an arbitrarily actuatable butterfly valve mounted in series within the induction manifold, with the air-flow measuring element being mounted for displacement in proportion to the air-flow in the induction manifold; a metering valve assembly including a movable part and metering valve apertures operatively associated with each engine cylinder and with the movable part, the movable part being connected to the air-flow measuring element and is thereby movable in response to the displacements of the air-flow measuring element; and means exerting a resetting force against the movable part in opposition to the displacement of the air-flow measuring element wherein the metering valve assembly, due to the movement of its movable part relative to the metering valve apertures, meters out fuel through the metering valve apertures in proportion to the air quantity flowing through the induction manifold while a constant pressure difference prevails at the metering valve apertures, the improvement comprising:

a differential pressure control valve, connected to said metering valve assembly; and a plurality of equal pressure valves connected with said metering valve assembly downstream of the metering apertures and with said differential pressure control valve; whereby the differential pressure control valve and the equal pressure valves cooperate with the metering valve assembly so as to maintain a constant pressure difference across the metering valve apertures.

2. A fuel injection system as defined in claim 1, wherein said differential pressure control valve is a flat seat valve with a diaphragm as the movable closure element, and including two chambers which are separated by said diaphragm.

3. A fuel injection system as defined in claim 2, further including a throttle through which said two chambers of said differential pressure control valve may communicate.

4. A fuel injection system as defined in claim 3, wherein said throttle is located within said diaphragm separating said two chambers.

5. A fuel injection system as defined in claim 1, wherein said differential pressure control valve and said equal pressure valves are connected in mutually parallel configuration.

6. A fuel injection system as defined in claim 1, further including a system pressure valve and a pressure control valve and wherein said differential pressure control valve, said pressure control valve and said system pressure valve are all embodied as flat seat valves having a diaphragm as their common movable closure element.

7. A fuel injection system as defined in claim 1, further including a system pressure valve and a pressure control valve, wherein said equal pressure valves, said differential pressure control valve, said pressure control valve and said system pressure valve are all embodied as flat seat valves having a diaphragm as their common movable closure element.

8. A fuel injection system as defined in claim 1, wherein said differential pressure control valve is in series connection with said equal pressure valves.

9. A fuel injection system as defined in claim 8, further including a throttle, located upstream of said differential pressure control valve; whereby said differential pressure control valve maintains a constant pressure difference across and said throttle and whereby said constant pressure difference is imparted through said equal pressure valves to said metering valve apertures.

10. A fuel injection system as defined in claim 1, further including a system pressure valve and a pressure control valve embodied together as a single valve.

11. A fuel injection system as defined in claim 1, further including a pressure control valve, wherein said resetting force is supplied by pressurized fuel and whereby said pressure control valve can change the pressure of said pressurized fuel in dependence on motor parameters.

* * * * *